US012232619B2

(12) United States Patent
Yang et al.

(10) Patent No.: US 12,232,619 B2
(45) **Date of Patent: *Feb. 25, 2025**

(54) SEAT FRAME

(71) Applicant: DEWERTOKIN TECHNOLOGY GROUP CO., LTD., Zhejiang (CN)

(72) Inventors: Liming Yang, Zhejiang (CN); Weiyao Zhou, Zhejiang (CN); Long Li, Zhejiang (CN)

(73) Assignee: DEWERTOKIN TECHNOLOGY GROUP CO., LTD., Jiaxing (CN)

( * ) Notice: Subject to any disclaimer, the term of this patent is extended or adjusted under 35 U.S.C. 154(b) by 0 days.

This patent is subject to a terminal disclaimer.

(21) Appl. No.: 18/657,305

(22) Filed: May 7, 2024

(65) Prior Publication Data

US 2024/0324777 A1 Oct. 3, 2024

Related U.S. Application Data

(63) Continuation of application No. 17/770,921, filed as application No. PCT/CN2022/073636 on Jan. 25, 2022.

(30) Foreign Application Priority Data

Oct. 30, 2021 (CN) ..... 202122972115.5

(51) Int. Cl.
*A47C 1/0355* (2013.01)

(52) U.S. Cl.
CPC ..... *A47C 1/0355* (2013.01)

(58) Field of Classification Search
CPC ..... A47C 1/0355
See application file for complete search history.

(56) References Cited

U.S. PATENT DOCUMENTS

| | | | | |
|---|---|---|---|---|
| 11,452,378 | B1 * | 9/2022 | Li | A47C 1/03211 |
| 2012/0286557 | A1 | 11/2012 | Hoffman et al. | |
| 2016/0058195 | A1 * | 3/2016 | Huang | A47C 1/031 248/398 |
| 2016/0088942 | A1 * | 3/2016 | Murphy | A47C 1/0345 297/361.1 |
| 2018/0027967 | A1 * | 2/2018 | Lawson | A47C 1/0355 |
| 2019/0313796 | A1 * | 10/2019 | Lapointe | A47C 3/03 |

FOREIGN PATENT DOCUMENTS

CN 212036846 U * 12/2020

OTHER PUBLICATIONS

Supplementary EPO Search Report in EP22717335, Mar. 19, 2024 (7 pages).

* cited by examiner

*Primary Examiner* — David R Dunn
*Assistant Examiner* — Tania Abraham

(57) ABSTRACT

A seat frame includes a base, a driving member and a stretching member. The driving member and the stretching member are disposed on the base. The stretching member includes backrest assemblies, cushion support assemblies and leg rest plate assemblies which are positioned on left and right sides of the base and set in pairs. A front end and a rear end of the cushion support assembly are hinged with one end of the backrest assembly and one end of the leg rest plate assembly respectively. When the seat frame is in a television (TV) posture and a lying posture, and the leg rest plate frame is inclined upward with respect to a horizontal plane.

19 Claims, 5 Drawing Sheets

SEAT FRAME

CROSS-REFERENCE TO RELATED APPLICATION(S)

This is continuation application of U.S. patent application Ser. No. 17/770,921, filed Apr. 21 2022, which is a national stage application filed under 37 U.S.C. 371 based on International Patent Application No PCT/CN2022/073636, filed Jan. 25, 2022, which claims priority to Chinese Patent Application No. 202122972115.5 filed with the CNIPA on Nov. 30, 2021, the disclosure of which is incorporated herein by reference in its entirety.

TECHNICAL FIELD

The present application relates to the field of furniture, for example, to a zero-gravity experience seat frame.

BACKGROUND

Seat is a common seating device in life. The seat usually includes a backrest, an armrest and the like. The structure and function of the seat in the related art are usually single, the state of the seat cannot be adjusted accordingly, and thus reducing the use comfort.

To improve the comfort at the time of lying and sitting, some seats can be adjusted to a zero-gravity state, such as a massage seat with a slideway zero-gravity structure disclosed by Chinese patent No. CN213157432U, which can achieve a zero-gravity effect and improve people's comfort, facilitate enhancing people's massage relaxation effect, and switch the massage seat between a zero-gravity posture and a standing posture by the driving of the electric push rod.

Chinese patent No. CN104936483A discloses a conventional intelligent sofa mechanical stretching device. The device includes a link gear including a pedal assembly, a seat-mounting plate, a base plate and a seat-adjusting assembly. The stretching or retraction of the link gear is achieved by a linear brake. In the stretching process of the conventional intelligent sofa mechanical stretching device, a lifting angle from the seat frame to the horizontal plane generally does not exceed 18°, the lifting of the seat frame angle of the sofa mechanical stretching device with the zero-gravity function is usually paid attention to. When such type of sofa mechanical stretching devices change from the sitting posture to the television (TV) posture, the seat frames usually have been obviously lifted. After fully stretching, the seat frame is further lifted, and the included angle between the fully stretched seat frame and the horizontal plane exceeds 18°, or even reaches more than 26°. (For example, CN111955974A discloses an electric seat link device, and its seat frame is at an angle between 18° and 26° from a horizontal direction when the seat is fully reclined.)

It is generally believed in the industry that the lifting of the seat frame angle is beneficial for the user to experience the weightlessness, that is, the so-called zero gravity function, so the research direction in the industry almost focuses on how to further lift the seat frame and the angle of the leg unit, and overemphasizing the lifting angle of the seat frame may make some first-time users too late to adapt to the angle change, which is counterproductive and generates dizziness.

SUMMARY

The present disclosure provides a leg-lift zero-gravity experience seat frame capable of experiencing the weightlessness and avoiding the dizziness without increasing the angle change of the seat frame.

A seat frame includes a base, a driving member and a stretching member. The driving member and the stretching member are disposed on the base. The stretching member includes backrest assemblies, cushion support assemblies and leg rest plate assemblies which are positioned on left and right sides of the base and set in pairs. A front end and a rear end of the cushion support assembly are hinged with one end of the backrest assembly and one end of the leg rest plate assembly respectively. The cushion support assembly includes a first support connector, a second support connector, a third support connector and a fourth support connector. One end of the third support connector is hinged at a middle of the fourth support connector, one end of the second support connector is hinged with the other end of the third support connector, and the first support connector is hinged with the backrest assembly. The leg rest plate assembly includes a first leg rest plate connector, a second leg rest plate connector, a third leg rest plate connector and a leg rest plate frame. One end of the first leg rest plate connector is hinged with one end of the fourth support connector, one end of the second leg rest plate connector is hinged with one end of the first support connector, the other end of the second leg rest plate connector is hinged with one end of the third leg rest plate connector, and the other end of the first leg rest plate connector and the other end of the third leg rest plate connector are hinged with the leg rest plate frame. When the seat frame is in a television (TV) posture and a lying posture, the leg rest plate frame is inclined upward with respect to a horizontal plane.

REFERENCE LIST

Figure 1:
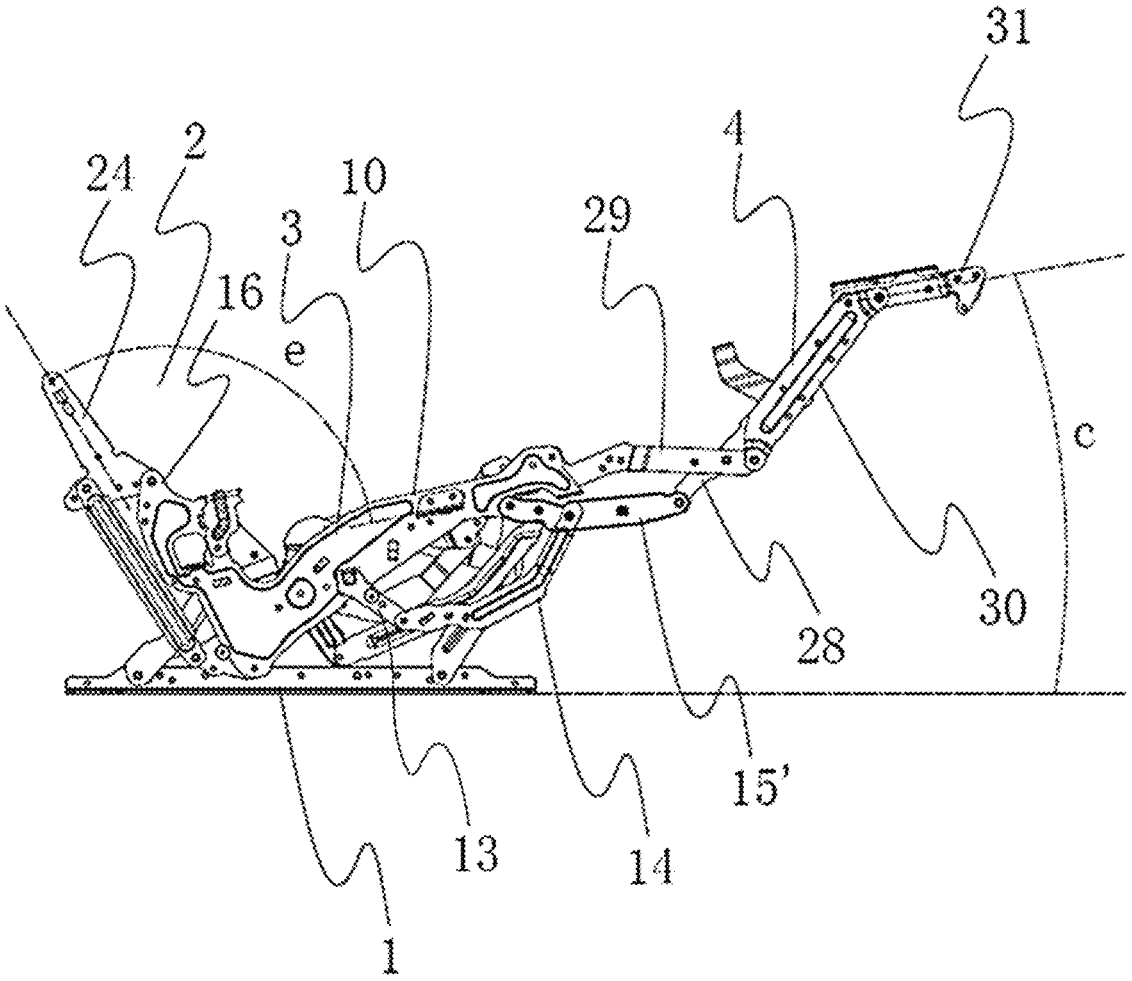
FIG. 1 is a side view of a leg-lift zero-gravity experience seat frame in a TV posture according to an embodiment of the present application.

1 base
2 backrest assembly
3 cushion support assembly
4 leg rest plate assembly
10 first support connector
13 second support connector
14 third support connector
15' fourth support connector
16 extension part
28 first leg rest connector
29 second leg rest connector
30 third leg rest connector
31 leg rest frame
17 first connector

20 second connector
24 first backrest connector
241 first hinge point
242 second hinge point
25 second backrest connector
26' third backrest connector
27 fourth backrest connector
261' first leg
262' second leg
263' third leg

DETAILED DESCRIPTION

Embodiments of the present disclosure will be described below based on the drawings.

No improvement has been performed on the leg unit and the foot rest plate in the zero-gravity sofa mechanical stretching device in the related art, and the foot rest plate is almost parallel to a horizontal plane during stretching. In the present application, the conventional iron frame is adjusted, so that on the basis of that the change angle of the seat frame is not increased or slightly increased, the user can experience the weightlessness and avoid the dizziness by lifting the leg unit and increasing the angle of the foot rest plate.

Figure 2:
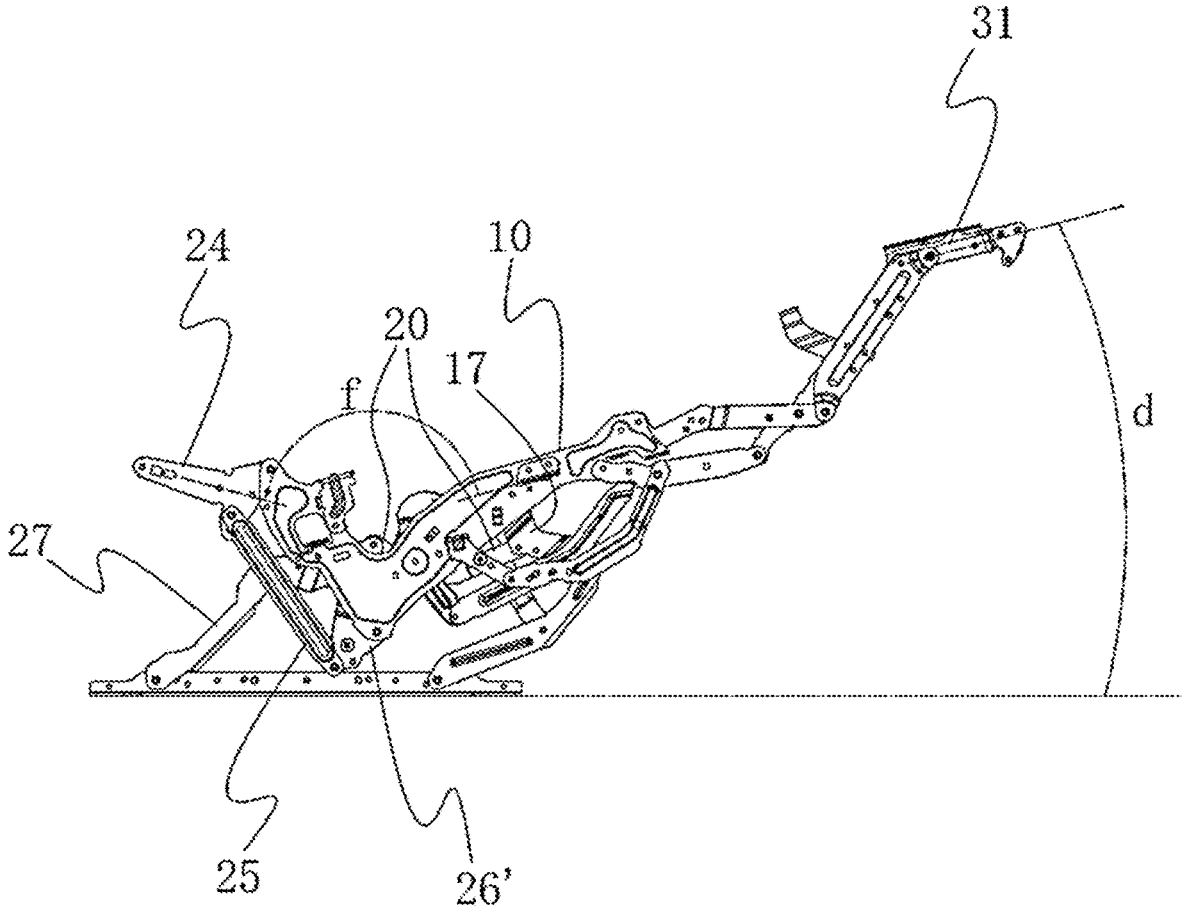
FIG. 2 is a side view of a leg-lift zero-gravity experience seat frame in a lying posture according to an embodiment of the present application.
Figure 3:
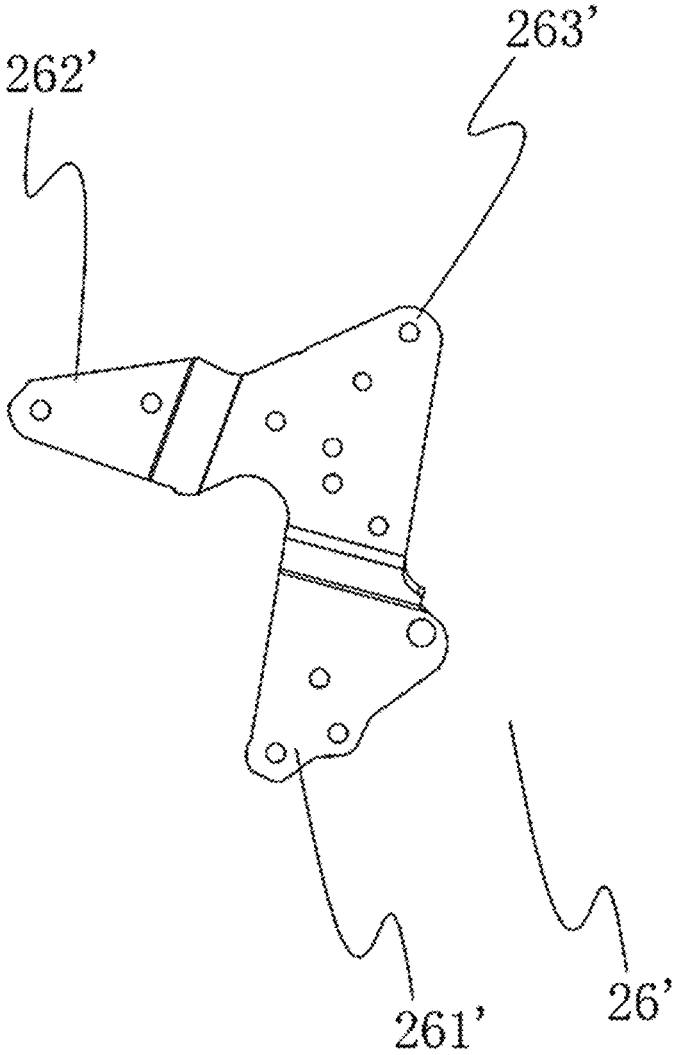
FIG. 3 is a side view of a third backrest connector in FIG. 2.
Figure 4:
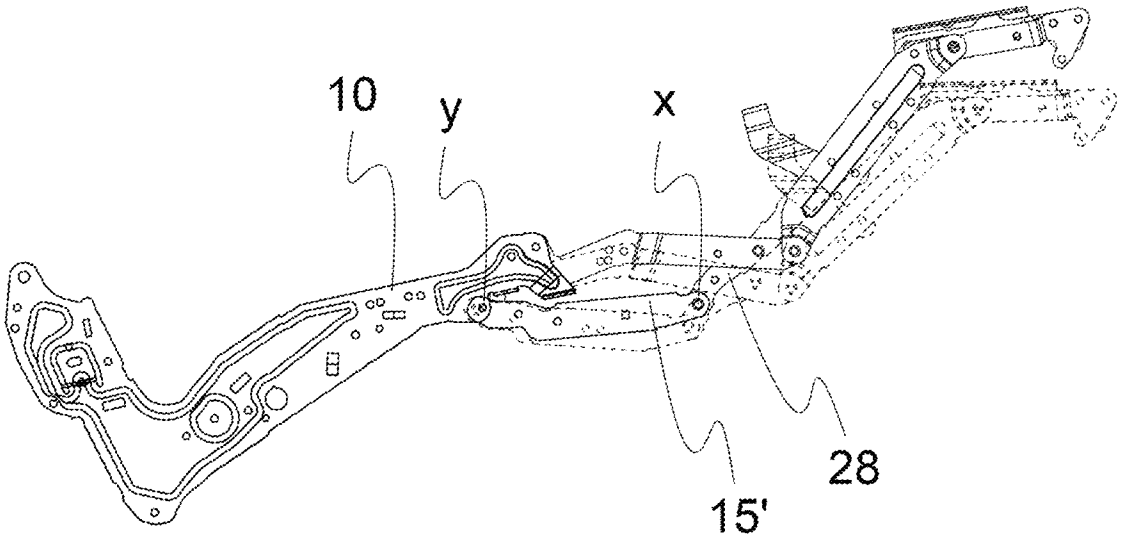
FIG. 4 is a schematic diagram comparing a fourth support connector (the solid line part) of a leg-lift zero-gravity experience seat frame according to an embodiment of the present application with corresponding links in the related art (the dashed line part)
Figure 5:
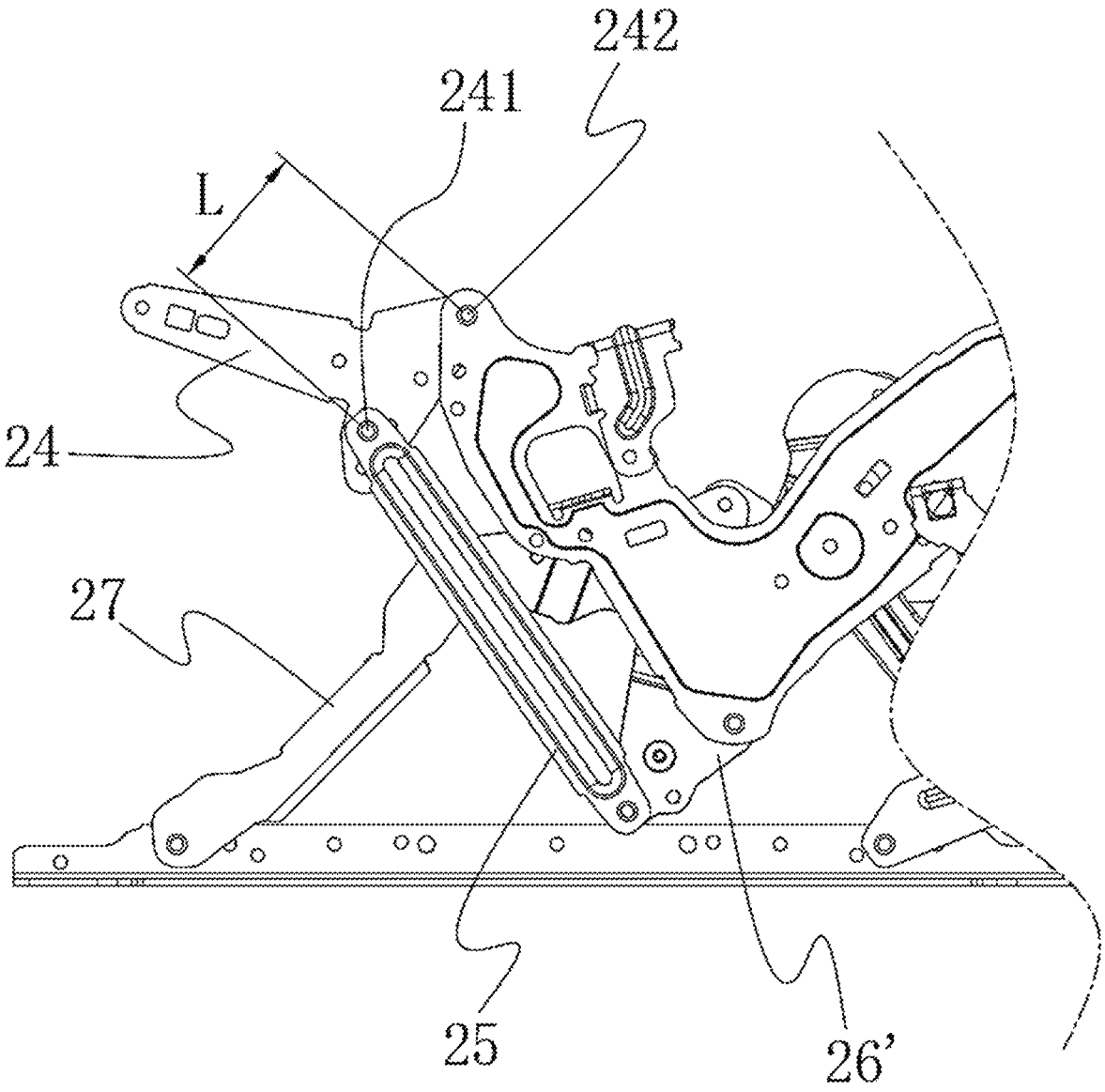
FIG. 5 is a partial schematic diagram of a backrest assembly of a leg-lift zero-gravity experience seat frame according to an embodiment of the present application.

Referring to FIGS. 1 to 5, the leg-lift zero-gravity experience seat frame provided in the present application is improved on the basis of the conventional sofa mechanical stretching device. The leg-lift zero-gravity experience seat frame provided in the present application includes a base 1, and a stretching member disposed on the base 1. The stretching member includes backrest assemblies 2, cushion support assemblies 3 and leg rest plate assemblies 4 which are positioned on left and right sides of the base I and set in pairs. A front end and a rear end of the cushion support assembly 3 are hinged with one end of the backrest assembly 2 and one end of the leg rest plate assembly 4 respectively. The position of the stretching assembly in a sitting posture, a lying posture and a TV posture is clear and stable, the stretching and folding sequence is clear, and the lying posture can enable the user to experience a zero-gravity feeling.

The cushion support assembly 3 includes a first support connector 10, a second support connector 13, a third support connector 14, and a fourth support connector 15'. One end of the third support connector 14 is hinged at a middle of the fourth support connector 15', and one end of the second support connector 13 is hinged with the other end of the third support connector 14. The first support connector 10 is provided with an extension part 16 which is obliquely and upwardly configured to be hinged with the backrest assembly 2. The leg rest plate assembly 4 includes a first leg rest plate connector 28, a second leg rest plate connector 29, a third leg rest plate connector 30 and a leg rest plate frame 31. One end of the first leg rest plate connector 28 is hinged with one end of the fourth support connector 15', one end of the first support connector 10 is hinged with the other end of the fourth support connector 15', one end of the second leg rest plate connector 29 is hinged with one end of the first support connector 10, the other end of the second leg rest plate connector 29 is hinged with one end of the third leg rest plate connector 30, and the other end of the first leg rest plate connector 28 and the other end of the third leg rest plate connector 30 are both hinged with the leg rest plate frame 31.

A hinge point X is a hinge point of the fourth support connector 15' and the first leg rest plate connector 28, a hinge point Y is a hinge point of the fourth support connector 15' and the first support connector 10, and a distance between the hinge point X and the hinge point Y is 180 to 200 mm. For example, the distance between the hinge point X and the hinge point Y is 187 to 195 mm. For another example, the distance between the hinge point X and the hinge point Y is 190 mm.

When the leg-lift zero-gravity experience seat frame is in the TV posture and the lying posture, a position at which the fourth support connector 15' is hinged with the first leg rest connector 28 is inclined upwards with respect to a position at which the third support connector 14 is hinged with the fourth support connector 15'.

When the leg-lift zero-gravity experience seat frame is in the TV posture, a first included angle c from a leg rest frame 31 to the horizontal plane is 5° to 15°, for example 8° to 11°. In this way, the leg rest assembly 4 can be wholly lifted, and the angle of the leg rest frame 31 can be further lifted.

When the leg-lift zero-gravity experience seat frame is in the lying posture, a second included angle d from the leg rest frame 31 to the horizontal plane is 12° to 20°, for example 12° to 15°. In this way, the angle of the leg rest frame 31 is further lifted, so that the user can experience the weightlessness.

When the leg-lift zero-gravity experience seat frame is in the TV posture, the first included angle c from the leg rest frame 31 to the horizontal plane is 10°; and when the leg-lift zero-gravity experience seat frame is in the lying posture, the second included angle d from the leg rest frame 31 to the horizontal plane is 14°.

The first support connector 10 is hinged with a first connector 17, the first connector 17 is hinged with a second connector 20, and the other end of the second connector 20 is hinged with the backrest assembly 2. The backrest assembly 2 includes a first backrest connector 24, a second backrest connector 25, a third backrest connector 26' and a fourth backrest connector 27, one end of a lower part of the first backrest connector 24 and one end of the second backrest connector 25 are hinged at a first hinge point 241, the other end of the lower part of the first backrest connector 24 and an extension part 16 of the first support connector 10 are hinged at a second hinge point 242, and a distance L between the first hinge point 241 and the second hinge point 242 is 70 to 85 mm, for example, the distance L is 74 mm. The third backrest connector 26' is V-shaped, two ends of the third backrest connector are respectively provided with a first leg 261' and a second leg 262', and a middle of the third backrest connector is protruded with a third leg 263'.

The first leg 261' of the third backrest connector 26 is hinged with the other end of the second backrest connector 25, the third leg 263' is hinged with one end of the second connector 20, the second leg 262' is hinged with one end of the fourth backrest connector 27, and the other end of the fourth backrest connector 27 is hinged with the base 1. A backrest spring is optionally disposed between the third backrest connector 26' and the extension part 16 of the first support connector 10.

Therefore, when the leg-lift zero-gravity experience seat frame is in the TV posture, a third included angle e between the first backrest connector 24 and the first support connector 10 ranges from 100° to 110°, and an included angle between the first support connector 10 and the horizontal plane is less than or equal to 13°; and when the leg-lift zero-gravity experience seat frame is in the lying posture, a fourth included angle f between the first backrest connector 24 and the first support connector 10 ranges from 140° to 150°, and the included angle between the first support connector 10 and the horizontal plane is less than or equal to 17°. Therefore, the backrest assembly 2 is much more backward and the lying posture is more comfortable.

When the leg-lift zero-gravity experience seat frame is in the TV posture, the third included angle e between the first backrest connector 24 and the first support connector 10 ranges from 109°, and the included angle between the first support connector 10 and the horizontal plane is 12°; and when the leg-lift zero-gravity experience seat frame is in the lying posture, the fourth included angle f between the first backrest connector 24 and the first support connector 10 is 149°, and the included angle between the first support connector 10 and the horizontal plane is 16°.

Compared with the related art, the leg-lift zero-gravity experience seat frame of the present application includes a base 1, a driving member and a stretching member. The driving member and the stretching member are disposed on the base 1. The stretching member includes backrest assemblies 2, the cushion support assemblies 3 and the leg rest plate assemblies 4 are positioned on left and right sides of the base and set in pairs. A front end and a rear end of the cushion support assembly 3 are hinged with one end of the backrest assembly 2 and one end of the leg rest plate assembly 4 respectively. The cushion support assembly 3 includes a first support connector 10, a second support connector 13, a third support connector 14 and a fourth support connector 15'. One end of the third support connector 14 is hinged at a middle of the fourth support connector 15', one end of the second support connector 13 is hinged with the other end of the third support connector 14, and the first support connector 10 is hinged with the backrest assembly 2. The leg rest plate assembly 4 includes a first leg rest plate connector 28, a second leg rest plate connector 29, a third leg rest plate connector 30 and a leg rest plate frame 31. One end of the first leg rest plate connector 28 is hinged with one end of the fourth support connector 15', one end of the second leg rest plate connector 29 is hinged with one end of the first support connector 10, the other end of the second leg rest plate connector 29 is hinged with one end of the third leg rest plate connector 30, the other end of the first leg rest plate connector 28, and the other end of the third leg rest plate connector 30 are hinged with the leg rest plate frame 31. When the leg-lift zero-gravity experience seat frame is in the television (TV) posture and the lying posture, the leg rest plate frame 31 is inclined upward with respect to a horizontal plane. In this way, on the basis of that the change angle of the seat frame does not increase, the user can experience the weightlessness and avoid the dizziness by increasing the angles of the leg unit and the foot rest plate, and increasing the stretching angle of the backrest unit.

In the description of the present application, the orientations or position relations indicated by terms such as "center", "above", "below", "left", "right", "vertical", "horizontal", "inside", "outside", "front", "rear" and the like are based on orientations or position relations shown in the drawings. These orientations or position relations are intended only to facilitate and simplify description of the present disclosure, and not to indicate or imply that a device or element referred to must have such specific orientations or must be configured or operated in such specific orientations. For example, a direction in which the leg (or the leg rest plate assembly 4) extends may be defined as the front (the front end), and a direction in which the backrest (or the backrest assembly 2) extends may be defined as the rear (the rear end). In addition, terms such as "first" and "second" are used only for the purpose of description and are not to be construed as indicating or implying relative importance.

What is claimed is:

1. A seat frame, comprising: a base, a driving member and a stretching member, wherein the driving member and the stretching member are disposed on the base, wherein the stretching member comprises backrest assemblies, cushion support assemblies and leg rest plate assemblies which are positioned on left and right sides of the base and set in pairs, wherein a front end and a rear end of each of the cushion support assemblies are hinged with one end of one of the backrest assemblies and one end of one of the leg rest plate assemblies respectively; each of the cushion support assemblies comprises a first support connector, a second support connector, a third support connector and a fourth support connector, wherein one end of the third support connector is hinged at a middle of the fourth support connector, one end of the second support connector is hinged with the other end of the third support connector, and the first support connector is hinged with one of the backrest assemblies; and wherein each of the leg rest plate assemblies comprises a first leg rest plate connector, a second leg rest plate connector, a third leg rest plate connector and a leg rest plate frame, wherein one end of the first leg rest plate connector is hinged with one end of the fourth support connector, one end of the second leg rest plate connector is hinged with one end of the first support connector, the other end of the second leg rest plate connector is hinged with one end of the third leg rest plate connector, the other end of the first leg rest plate connector and the other end of the third leg rest plate connector are hinged with the leg rest plate frame; and when the seat frame is in a television (TV) posture and a lying posture, the leg rest plate frame is inclined upward with respect to a horizontal plane;

wherein a hinge point X is a hinge point of the fourth support connector and the first leg rest plate connector, a hinge point Y is a hinge point of the fourth support connector and the first support connector, and a distance between the hinge point X and the hinge point Y is 180 to 200 mm.

2. The seat frame of claim 1, wherein when the seat frame is in the TV posture, a first included angle from the leg rest plate frame to the horizontal plane is 5° to 15°.

3. The seat frame of claim 2, wherein when the seat frame is in the TV posture, a first included angle from the leg rest plate frame to the horizontal plane is 8° to 11°.

4. The seat frame of claim 3, wherein when the seat frame is in the TV posture, the first included angle from the leg rest plate frame to the horizontal plane is 10°.

5. The seat frame of claim 1, wherein when the seat frame is in the lying posture, a second included angle from the leg rest plate frame to the horizontal plane is 12° to 20°.

6. The seat frame of claim 5, wherein when the seat frame is in the lying posture, the second included angle from the leg rest plate frame to the horizontal plane is 12° to 15°.

7. The seat frame of claim 6, wherein when the seat frame is in the lying posture, the second included angle from the leg rest plate frame to the horizontal plane is 14°.

8. The seat frame of claim 1, wherein the distance between the hinge point X and the hinge point Y is 187 to 195 mm.

9. The seat frame of claim 8, wherein the distance between the hinge point X and the hinge point Y is 190 mm.

10. The seat frame of claim 1, the first support connector is hinged with a first connector, the first connector is hinged with a second connector, the other end of the second connector is hinged with the one of the backrest assemblies;

wherein each of the backrest assemblies comprises a first backrest connector, a second backrest connector, a third backrest connector and a fourth backrest connector, one end of a lower part of the first backrest connector and one end of the second backrest connector are hinged at a first hinge point, the other end of the lower part of the first backrest connector and an extension part of the first support connector are hinged at a second hinge point, and a distance L between the first hinge point and the second hinge point is 70 to 85 mm; the third backrest connector is V-shaped, two ends of the third backrest connector are respectively provided with a first leg and a second leg, and a middle of the third backrest connector is protruded with a third leg; and the first leg of the third backrest connector is hinged with the other end of the second backrest connector, the third leg is hinged with one end of the second connector, the second leg is hinged with one end of the fourth backrest connector, and the other end of the fourth backrest connector is hinged with the base.

11. The seat frame of claim 10, wherein when the seat frame is in the TV posture, an included angle between the first support connector and the horizontal plane is less than or equal to 12°; and when the seat frame is in the lying posture, the included angle between the first support connector and the horizontal plane is less than or equal to 17°.

12. The seat frame of claim 11, wherein when the seat frame is in the TV posture, an included angle between the first support connector and the horizontal plane is less than or equal to 12°; and when the seat frame is in the lying posture, the included angle between the first support connector and the horizontal plane is less than or equal to 16°.

13. The seat frame of claim 12, wherein when the seat frame is in the TV posture, a third included angle between the first backrest connector and the first support connector ranges from 100° to 110°; and when the seat frame is in the lying posture, a fourth included angle between the first backrest connector and the first support connector ranges from 140° to 150°.

14. The seat frame of claim 13, wherein when the seat frame is in the TV posture, the third included angle between the first backrest connector and the first support connector is 109°; and when the seat frame is in the lying posture, the fourth included angle between the first backrest connector and the first support connector is 149°.

15. The seat frame of claim 10, wherein when the seat frame is in the TV posture, a first included angle from the leg rest plate frame to the horizontal plane is 5° to 15°.

16. The seat frame of claim 15, wherein when the seat frame is in the TV posture, a first included angle from the leg rest plate frame to the horizontal plane is 8° to 11°.

17. The seat frame of claim 16, wherein when the seat frame is in the TV posture, the first included angle from the leg rest plate frame to the horizontal plane is 10°.

18. The seat frame of claim 10, wherein when the seat frame is in the lying posture, a second included angle from the leg rest plate frame to the horizontal plane is 12° to 20°.

19. The seat frame of claim 18, wherein when the seat frame is in the lying posture, the second included angle from the leg rest plate frame to the horizontal plane is 12° to 15°.

* * * * *